US007404703B2

(12) United States Patent
Wang

(10) Patent No.: US 7,404,703 B2
(45) Date of Patent: Jul. 29, 2008

(54) AIR PUMP WITH APPARATUS TO HOLD NOZZLE

(75) Inventor: Lo-Pin Wang, 16F-2, No. 17, Lane 52, Sec. 3, Re He Rd., Taichung (TW)

(73) Assignee: Lo-Pin Wang, Taichung (TW)

( * ) Notice: Subject to any disclaimer, the term of this patent is extended or adjusted under 35 U.S.C. 154(b) by 853 days.

(21) Appl. No.: 10/945,991

(22) Filed: Sep. 22, 2004

(65) Prior Publication Data

US 2006/0060672 A1 Mar. 23, 2006

(51) Int. Cl.
*A61M 1/00* (2006.01)
*F01B 31/00* (2006.01)
*B05B 7/02* (2006.01)

(52) U.S. Cl. ..... 417/437; 417/572; 92/58.1; 239/526

(58) Field of Classification Search ..... 417/437, 417/572; 92/58.1; 239/525, 526, 530
See application file for complete search history.

(56) References Cited

U.S. PATENT DOCUMENTS

| | | | | |
|---|---|---|---|---|
| 785,154 | A * | 3/1905 | Cordeau | 92/15 |
| 2,462,980 | A * | 3/1949 | Litt | 92/58.1 |
| 5,494,411 | A * | 2/1996 | Chuang | 417/234 |
| 6,558,129 | B2 * | 5/2003 | Wang | 417/63 |
| 6,736,619 | B2 * | 5/2004 | Wu | 417/572 |

* cited by examiner

*Primary Examiner*—Charles G Freay
(74) *Attorney, Agent, or Firm*—Browdy and Neimark

(57) ABSTRACT

An air pump has a cylinder, a shaft to be manipulative for inflation, a hose connected to the cylinder, a nozzle connected to an end of the hose and a handle pivoted on an end of the shaft. The handle is manipulative to be moved between an expanded position and a collapsed position. The handle is provided with a receiving portion to receive a portion of the shaft therein while the handle is moved to the collapsed position and an engaging portion to be engaged with the nozzle. The cylinder has a channel to receive the hose therein.

9 Claims, 4 Drawing Sheets

AIR PUMP WITH APPARATUS TO HOLD NOZZLE

BACKGROUND OF THE INVENTION

1. Field of the Invention

The present invention relates to an air pump, and more particularly to an air pump, which the nozzle and the hose are held on the cylinder firmly.

2. Description of the Related Art

A conventional air pump has a cylinder, a shaft with a handle to reciprocate a piston in the cylinder, a hose connected to the cylinder and having a nozzle and a C-shaped clip mounted on the cylinder to hold the nozzle.

In practice, the clip cannot hold the nozzle firmly that the nozzle is easy to be released by unexpected force. The clip is exposed out of the cylinder that increases the size of the air pump and that is inconvenient for storage. The hose is suspended while the nozzle is held by the clip that the hose is easy to be wrested unexpectedly.

SUMMARY OF THE INVENTION

The primary objective of the present invention is to provide an air pump, which holds the nozzle and the hose on the cylinder firmly.

The secondary objective of the present invention is to provide an air pump, which the cylinder is provided with no exposed device to hold the nozzle to reduce the size of the air pump.

The third objective of the present invention is to provide an air pump, which the hose is not suspended from the cylinder.

According to the objectives of the present invention, an air pump comprises a cylinder, a shaft to be manipulative for inflation, a hose connected to the cylinder, a nozzle connected to an end of the hose and a handle pivoted on an end of the shaft to be moved between an expanded position and a collapsed position, wherein the handle is provided with a receiving portion to receive a portion of the shaft therein while the handle is moved to the collapsed position and an engaging portion to be engaged with the nozzle.

DETAILED DESCRIPTION OF THE INVENTION

Figure 1:
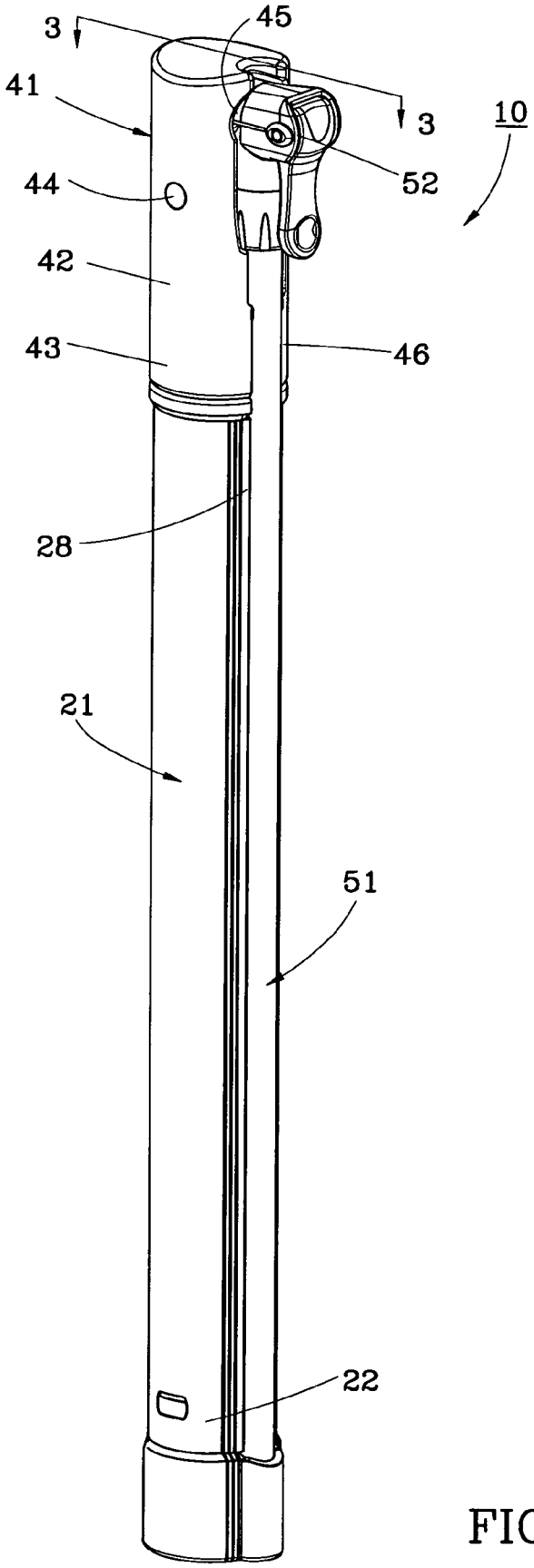
FIG. 1 is a perspective view of a first preferred embodiment the present invention, showing the hose and the nozzle held on the cylinder.
Figure 2:
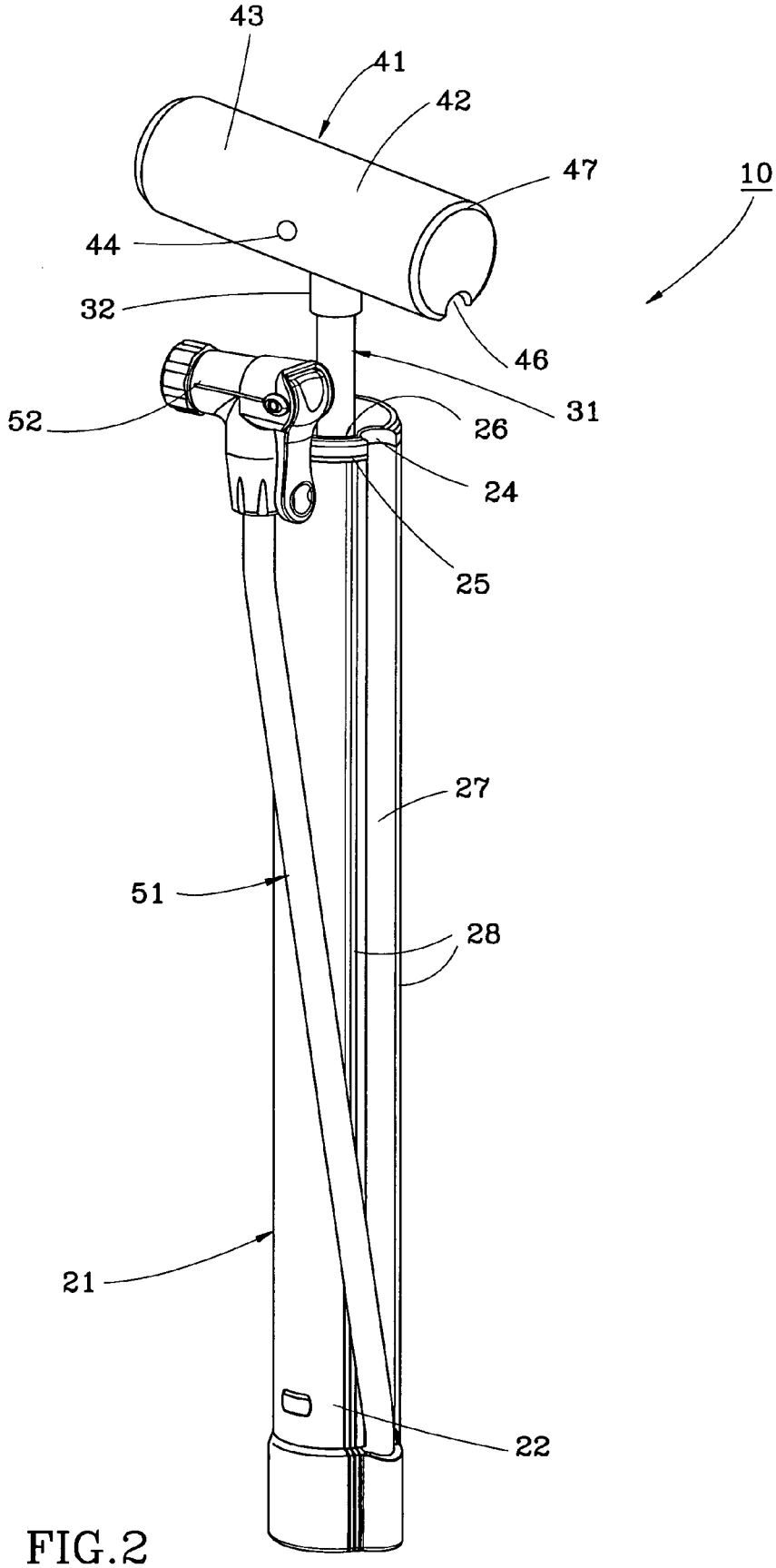
FIG. 2 is a perspective view of the first preferred embodiment of the present invention, showing the hose and the nozzle drawn out and ready for inflation.
Figure 3:
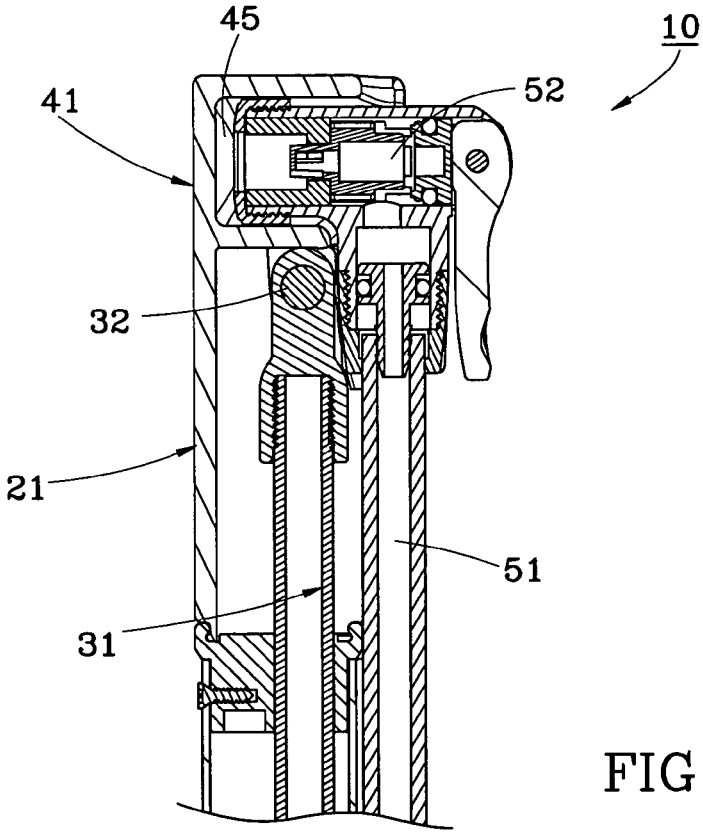
FIG. 3 is a sectional view along the 3-3 line of FIG. 1.

As shown in FIG. 1 to FIG. 3, an air pump 10 of the first preferred embodiment of the present invention comprises a cylinder 21, a shaft 31, a handle 41 and a hose 51.

The cylinder 21 has a close end 22 at a bottom thereof and an open end at a top thereof, in which a plunger 24 is squeezed. The plunger 24 has a first lock portion 25 at a top thereof and a through hole 26 at a center thereof. The cylinder 21 has an elongated channel 27 at an outer surface thereof, which has two opposite walls 28.

A piston (not shown) is received in the cylinder 21 and is connected to the shaft 31. The shaft 31 runs through the through hole 26 of the plunger 24 to be connected to the handle 41. The handle 41 is manipulative to reciprocate the piston.

The handle 41 has a main member 42 and a pin 44 connecting the main member 42 to a pivot portion 32 of the shaft 31, so that the main member 42 of the handle 41 is pivoted on the shaft 31 and is moved between an expanded position and a collapsed position. The main member 42 further has a receiving portion 43 and an engaging portion 45, which is a slot in the present preferred embodiment, at opposite side of the pin 44. The receiving portion 43 has a gap 46 and a second lock portion 47. While the main member 42 is moved to the collapsed position, referring to FIG. 1, the shaft 31 has a portion received in the receiving portion 43 via the gap 46 and the second lock portion 47 of the handle 41 is locked with the first lock portion 25 of the cylinder 21 to hold the handle 41 at the collapsed position. While the main member 42 is moved to the expanded position, referring to FIG. 2, the shaft 31 escapes from the receiving portion 43 and move to where substantially perpendicular to the shaft 31.

The hose 51 has an end connected to the inside of the cylinder 21 and a nozzle 52 is connected to an end of the hose 51. The nozzle 52 is engaged with the slot 48 of the handle 41, referring to FIG. 3, and the hose 51 is squeezed into the channel 27 of the cylinder 21. A distance between the walls 28 of the channel 27 is slightly less than a diameter of the hose 51, so that the hose 51 is positioned in the channel 27 firmly.

As shown in FIG. 2, the nozzle 52 and the hose 51 are drawn out from the slot 45 and the channel 27 respectively and the handle 41 is turned to the expanded position, such that the air pump 10 of the present invention is ready for inflation.

In conclusion, the present invention provides the slot 45 on the handle 41 to replace the clip of the conventional air pump to hold the nozzle. The nozzle 52 is received in the slot 45, which holds the handle 41 at the collapsed position and also holds the shaft 21 from movement and rotation. The hose 51 is received in the channel 27 of the cylinder 21, which make the hose 51 not suspended.

The cylinder can be provided with two parallel walls projected from the outer surface, between which is the channel. The hose is rested and held between the walls.

Figure 4:
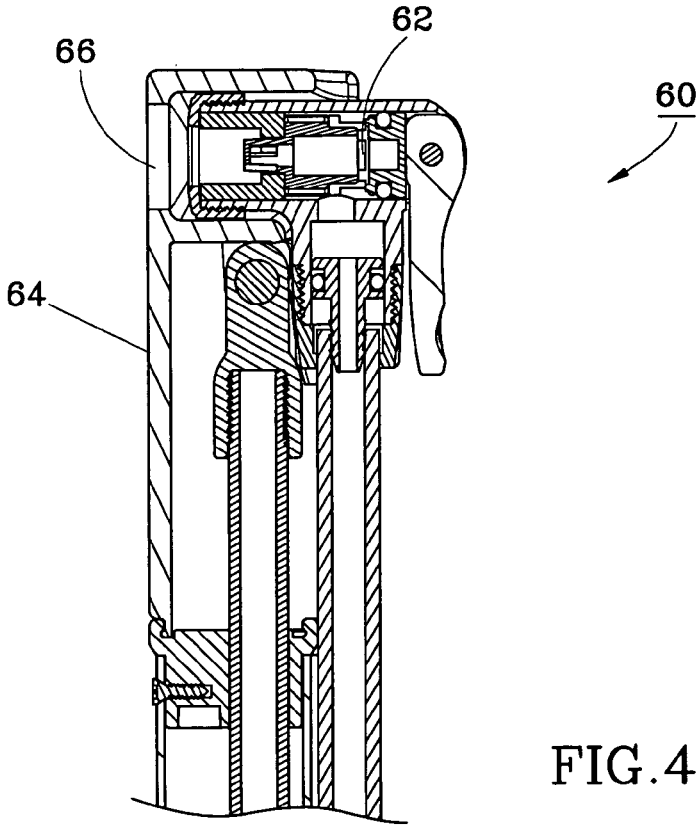
FIG. 4 is a sectional view in part of a second preferred embodiment of the present invention.

As shown in FIG. 4, an air pump 60 of the second preferred embodiment of the present invention, which is similar to the air pump 10 of the first preferred embodiment, has a nozzle 62 fitted to a through hole 66 on a handle 64. The through hole 66 of the second preferred embodiment and the slot 45 both serve the same function of holding the nozzle.

Figure 5:
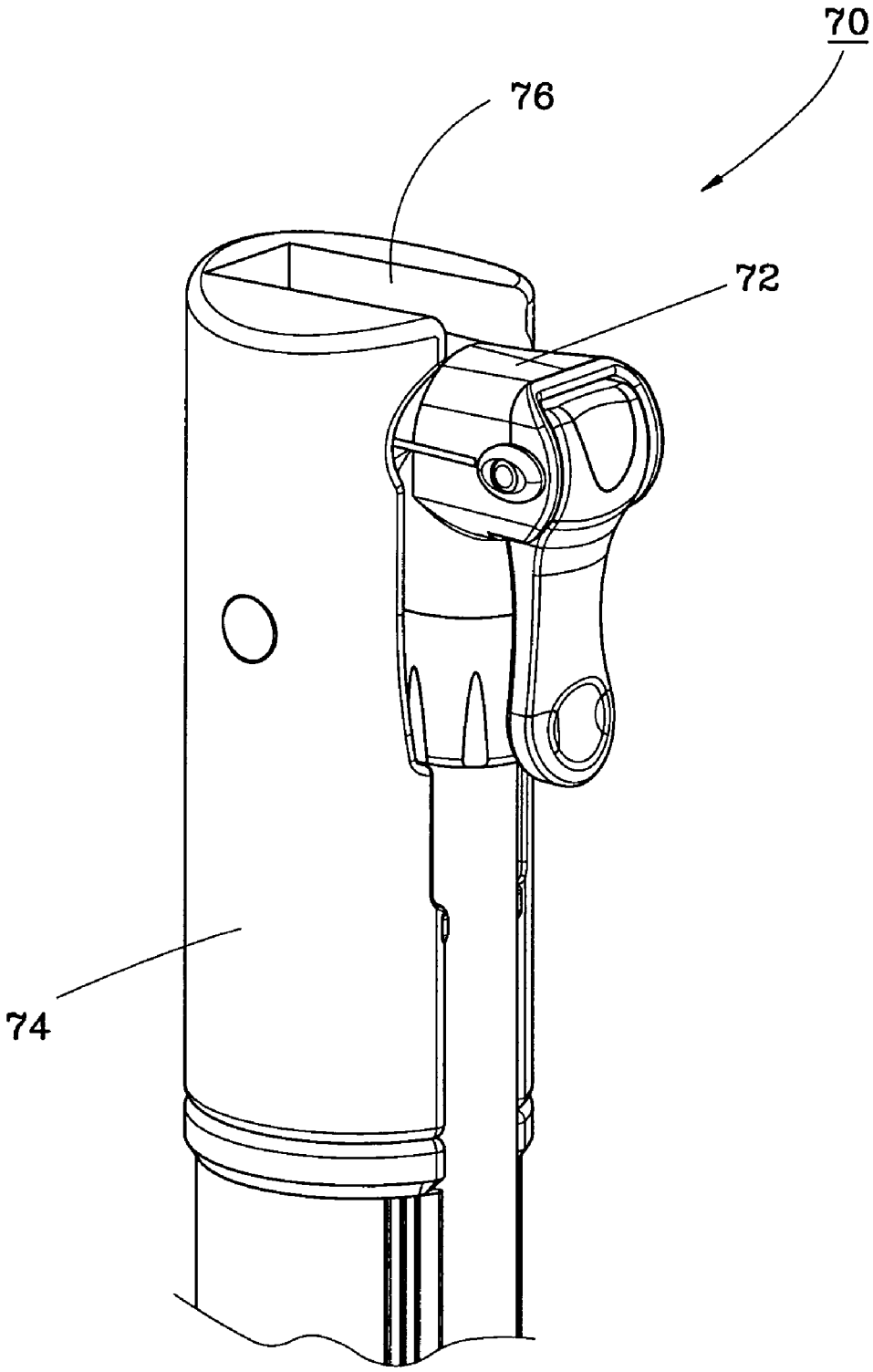
FIG. 5 is a perspective view in part of a third preferred embodiment of the present invention.

As shown in FIG. 5, an air pump 70 of the second preferred embodiment of the present invention has a handle 74 has a concave recess 76, which is open both at an end and a circumference of the handle 74. A nozzle 72 is engaged with the concave recess 76.

What is claimed is:

1. An air pump, comprising a cylinder, a shaft to be manipulative for inflation, a hose connected to the cylinder, a nozzle connected to an end of the hose and a handle pivoted on an end of the shaft to be moved between an expanded position and a collapsed position, wherein the handle is provided with a receiving portion to receive a portion of the shaft therein while the handle is moved to the collapsed position and an engaging portion to be engaged with the nozzle.

2. The air pump as defined in claim 1, wherein the handle has a gap communicated to the receiving portion and the handle is attached on the shaft and receives the shaft in the receiving portion via the gap while the handle is moved to the collapsed position and the shaft leaves the receiving portion via the gap and the handle moves to where it is substantially perpendicular to the shaft while the handle is moved to the expanded position.

3. The air pump as defined in claim 1, wherein the engaging portion of the handle is a slot on the handle.

4. The air pump as defined in claim 1, wherein engaging portion of the handle is a through hole on the handle.

5. The air pump as defined in claim 1, wherein engaging portion of the handle is a concave recess on the handle.

6. The air pump as defined in claim 1, wherein the cylinder has a first lock portion and the handle has a second lock portion to be locked with the first lock portion while the handle is moved to the collapsed position.

7. The air pump as defined in claim 1, wherein the hose is attached on an outer surface of the cylinder while the nozzle is engaged with the engaging portion of the handle.

8. The air pump as defined in claim 1, wherein the cylinder has a channel on an outer surface thereof, in which the hose is received.

9. The air pump as defined in claim 8, wherein the cylinder has two walls projected from the outer surface thereof, between which is the channel.

* * * * *